United States Patent [19]

Müller et al.

[11] Patent Number: 4,589,325

[45] Date of Patent: May 20, 1986

[54] CARTRIDGE CONVEYOR, ESPECIALLY FOR CONVEYING CARTRIDGES FROM A DRUM-TYPE MAGAZINE TO A FIRING WEAPON

[75] Inventors: Kurt Müller, Glattbrugg; Paul Kalt, Zurich; Pirmin Steiner, Oberengstringen; Ernst Hürlemann, Zurich, all of Switzerland

[73] Assignee: Werkzeugmaschinenfabrik Oerlikon-Bührle AG, Zurich, Switzerland

[21] Appl. No.: 560,373

[22] Filed: Dec. 12, 1983

[30] Foreign Application Priority Data

Dec. 22, 1982 [CH] Switzerland ..... 7474/82

[51] Int. Cl.[4] ..... F41D 9/02

[52] U.S. Cl. ..... 89/33.02; 89/34; 198/467.1

[58] Field of Search ..... 89/33.02, 34, 33.5, 89/33.1, 33.14; 198/475

[56] References Cited

U.S. PATENT DOCUMENTS

| | | | |
|---|---|---|---|
| 2,284,286 | 5/1942 | Krueger | 198/475 |
| 2,756,637 | 7/1956 | Maillard | 89/33.02 |
| 2,854,125 | 9/1958 | Johnson | 198/475 X |
| 2,910,917 | 11/1959 | Herlach et al. | 89/33.02 X |
| 2,935,914 | 5/1960 | Darsie et al. | 89/33.02 |
| 2,993,415 | 7/1961 | Panicci et al. | 89/33.02 X |
| 3,437,005 | 4/1969 | Trumper | 89/33.02 |
| 3,683,743 | 8/1972 | Stoner | 89/33.02 |
| 3,696,704 | 10/1972 | Backus et al. | 89/34 |
| 3,881,395 | 5/1975 | Cozzi et al. | 89/34 |
| 4,393,746 | 7/1983 | Rocha | 89/34 |
| 4,492,144 | 1/1985 | Dix | 89/34 X |

FOREIGN PATENT DOCUMENTS

| | | |
|---|---|---|
| 1026201 | 3/1958 | Fed. Rep. of Germany . |
| 2403467 | 10/1974 | Fed. Rep. of Germany . |
| 833617 | 7/1938 | France . |
| 956038 | 7/1949 | France . |
| 1247266 | 10/1960 | France . |
| 2048696 | 3/1971 | France . |
| 2237816 | 2/1975 | France . |

*Primary Examiner*—David H. Brown

*Attorney, Agent, or Firm*—Werner W. Kleeman

[57] ABSTRACT

To feed cartridges from a drum-type or drum magazine to a firing weapon a first conveyor is required to push the cartridges out from the drum-type magazine in which the cartridges are arranged in a number of rows. A second conveyor feeds the cartridges which have been ejected from the drum-type magazine to the firing weapon. At high firing rates as required in multi-barrel guns or weapon systems difficulties can occur in the transfer of the cartridges from the first conveyor to the second conveyor and during the acceleration of the rows of cartridges in the drum-type magazine. According to the invention return or reverse movement blocking devices are arranged between the two conveyors and the first conveyor comprises a screw or worm conveyor having a first turn of the thread which is of smaller pitch than the remaining turns of the thread to facilitate the acceleration of the rows of the cartridges which are initially at standstill in the drum-type magazine.

14 Claims, 12 Drawing Figures

FIG. 1
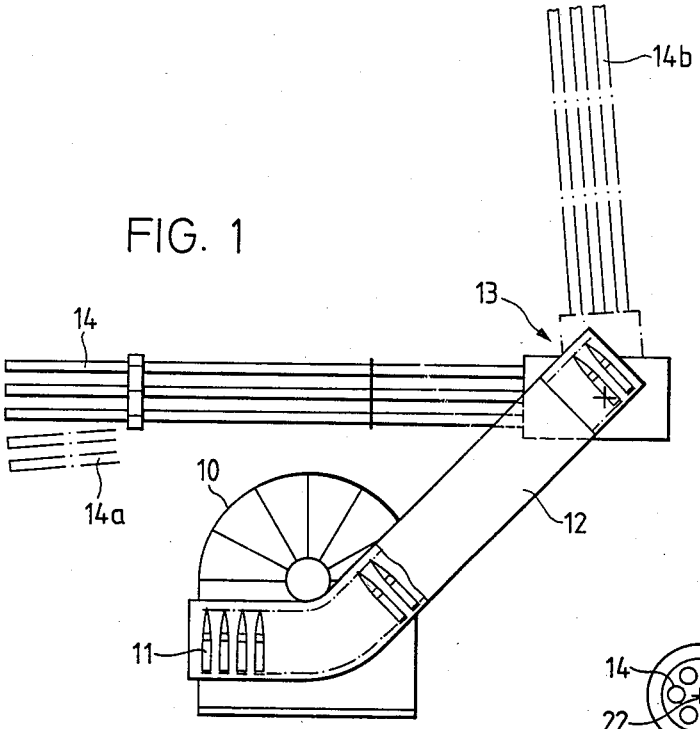
FIG. 3
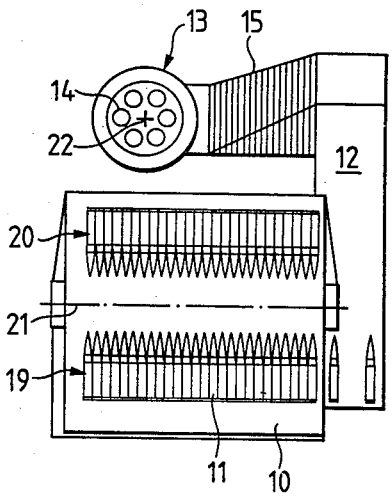
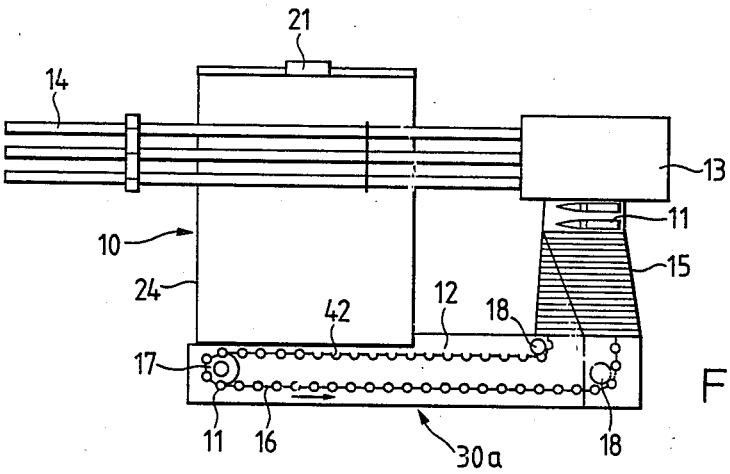
FIG. 2

CARTRIDGE CONVEYOR, ESPECIALLY FOR CONVEYING CARTRIDGES FROM A DRUM-TYPE MAGAZINE TO A FIRING WEAPON

CROSS-REFERENCE TO RELATED APPLICATIONS

This application is related to (i) the commonly assigned, copending U.S. application Ser. No. 06/266,087, filed May 21, 1981, entitled "AMMUNITION CHANNEL", now U.S. Pat. No. 4,416,184, granted Nov. 22, 1983; and (ii) the commonly assigned, copending U.S. application Ser. No. 06/419,763, filed Sept. 20, 1982, now U.S. Pat. No. 4,445,419, granted May 1, 1984, and entitled "AMMUNITION CONTAINER, ESPECIALLY DRUM MAGAZINE".

BACKGROUND OF THE INVENTION

The present invention relates to a new and improved ammunition feed apparatus or system for feeding cartridges from a drum-type or drum magazine to a firing weapon or system.

In its more particular aspects, the present invention relates specifically to a new and improved ammunition feed apparatus or system for feeding cartridges to a firing weapon or system from a drum-type or drum magazine subdivided into a predetermined number of sectors in each of which there is accommodated a row or series of cartridges. The feed apparatus or system comprises a first conveyor for pushing the cartridge rows or series one after the other out from the sectors or individual compartments of the drum-type magazine and a second conveyor for transporting the cartridges which have been pushed out from the sectors to the firing weapon.

In a feed apparatus or system of this kind as known, for example, from German Pat. No. 1,026,201, the first conveyor comprises a circulating endless chain which is provided with entraining or entrainment members and which is drivingly connected to the rotating drum-type magazine. The cartridges are transferred from the first conveyor to a second conveyor which is drivingly connected to the first conveyor and comprises a conveyor plate which, in turn, further feeds the cartridges to the weapon.

This known feed system is unfavorable in the event that the cartridges have to be removed from the drum-type or drum magazine either from the top or from a side thereof, because there then exists the danger of the cartridges dropping back into the empty sectors of the drum-type magazine. Furthermore, at high firing rates difficulties can occur in the transfer of the cartridges from the first conveyor to the second conveyor. In this known feed system there are furthermore required, particularly at high firing rates, high accelerating forces in order to suddenly accelerate an entire cartridge row or series from standstill. High acceleration forces are also required in order to accelerate the cartridges to a substantially higher feed rate during the transfer of the cartridges from the first conveyor to the second conveyor.

SUMMARY OF THE INVENTION

Therefore, with the foregoing in mind it is a primary object of the present invention to provide a new and improved feed apparatus or system for feeding cartridges from a drum magazine to a firing weapon or system, wherein a reliable transporting of the cartridges from the drum magazine to the firing weapon is ensured even with high firing rates of the weapon.

Another important object of the present invention is directed to the provision of a new and improved feed apparatus or system for feeding cartridges from a drum magazine to a firing weapon in which there is accomplished reliable transfer of the cartridges from a first conveyor to a second conveyor without any cartridges dropping into already emptied sectors or compartments of the drum magazine.

Still a further significant object of the present invention is directed to a new and improved construction of a feed apparatus or system for feeding cartridges from a drum magazine to a firing weapon in which there do not occur any high acceleration forces when a cartridge row or series is pushed out from a sector or compartment of the drum magazine.

Another important object of the present invention is directed to a new and improved construction of a feed apparatus or system for feeding cartridges from a drum magazine to a firing weapon in which there do not occur any high accelerating forces during the transfer of the cartridges from a first conveyor to a second conveyor.

Now in order to implement these and still further objects of the invention, which will become more readily apparent as the description proceeds, the feed apparatus or system of the present development is manifested by the features that, a return or reverse movement blocking device is arranged between the two conveyors, and the first conveyor comprises a screw or worm conveyor, the first thread turn of which has a smaller pitch than the remaining thread turns.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various Figures of the drawings there have been generally used the same reference characters to denote the same or analogous components and wherein:

FIG. 1 is a side view of a firing weapon provided with a drum-type or drum magazine and a first exemplary embodiment of the feed apparatus or system according to the invention for feeding cartridges from the drum magazine to the firing weapon;

FIG. 2 is a plan view of the firing weapon and ammunition feed apparatus shown in FIG. 1;

FIG. 3 is a schematic end view of the firing weapon and related ammunition feed apparatus shown in FIG. 1;

DETAILED DESCRIPTION OF THE PREFERRED EMBODIMENTS

Figure 4:
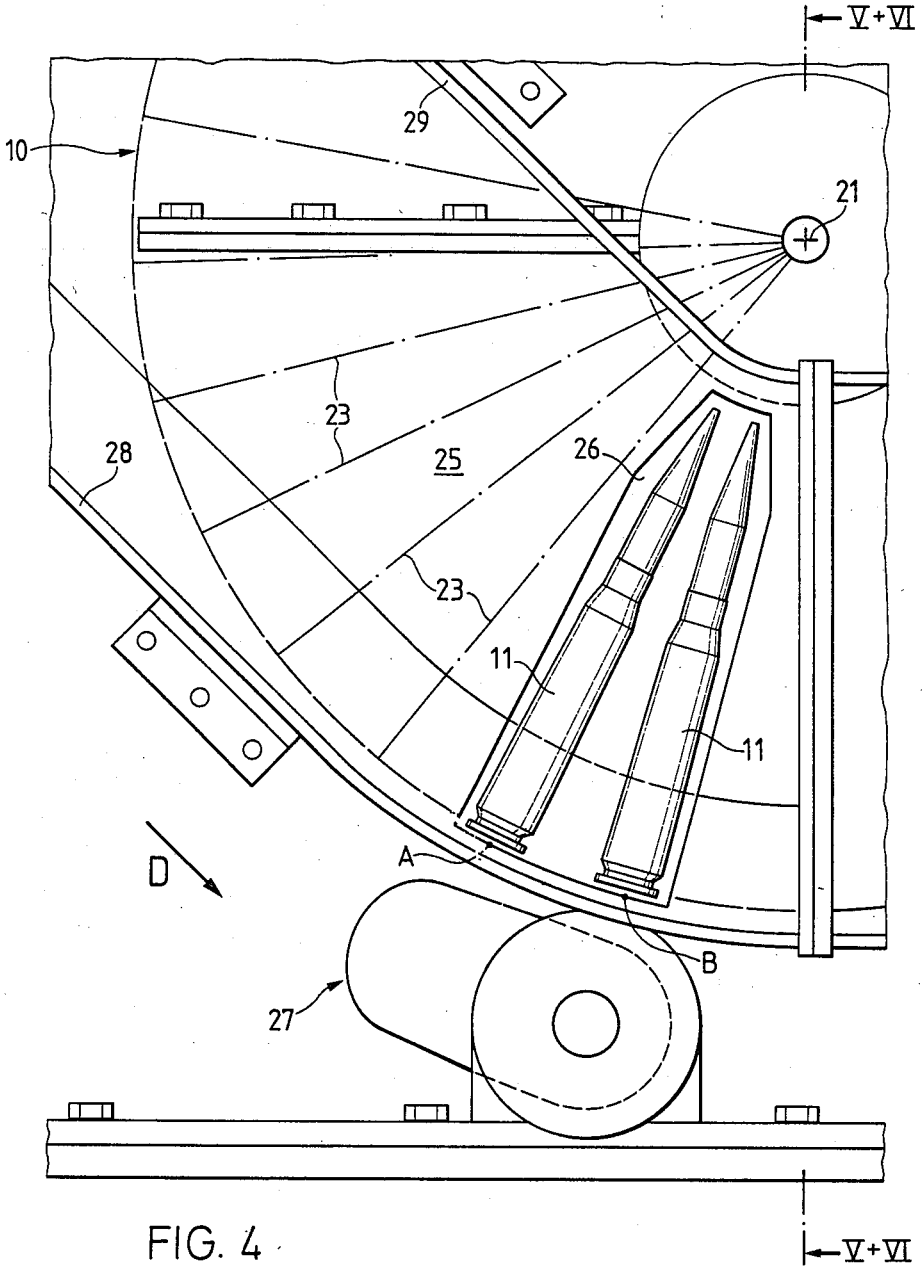
FIG. 4 is a fragmentary front view of the drum magazine shown in FIG. 1.

Describing now the drawings, it is to be understood that only enough of the construction of the ammunition feed apparatus or system and the related firing weapon has been shown as needed for those skilled in the art to readily understand the underlying principles and concepts of the present development, while simplifying the showing of the drawings. Turning attention now specifically to FIG. 1, there has been schematically illustrated a side view of a firing weapon arrangement in which cartridges 11 are fed to a firing weapon or system 13 from a drum-type or drum magazine 10 through a conveyor passage or channel 12. In FIG. 1 the firing weapon 13 is shown in three different elevational positions. In the intermediate position the weapon barrels 14 of the firing weapon 13 are essentially horizontally directed. From this position the firing weapon or system 13 may be depressed or lowered, on the one hand, until the weapon barrels 14 are downwardly inclined by approximately 10°–15° with respect to the horizontal and, on the other hand, the firing weapon 13 can be elevated by approximately 90° until the weapon barrels 14 approximately project towards the zenith. The downwardly inclined or depressed weapon barrels are conveniently designated by reference character 14*a*, while the weapon barrels 14 in a position thereof projecting towards the zenith are conveniently designated by reference character 14*b*.

According to the illustration of FIG. 2, a so-called plate or disk passage or channel 15 is arranged between the conveying passage or channel 12 and the firing weapon 13 and such permits an elevation of the firing weapon 13 through an angle of approximately 90°. The cartridges 11 are passed from the drum magazine 10 to an endless conveyor device, here an endless conveyor chain 16. At one end of the conveying passage or channel 12 the conveyor chain 16 is deflected around a sprocket wheel 17 or equivalent structure. Adjacent the firing weapon 13 there is located a further not particularly illustrated sprocket wheel which serves to appropriately deflect the conveyor chain 16. This conveyor chain 16 is passed through the plate or disk channel 15. At the inlet side of the disk or plate channel 15 there are provided deflection rolls 18 for the conveyor chain 16.

In FIG. 3 there are depicted two cartridge rows or series 19 and 20 which are located within the drum magazine 10. The cartridge row 19 is fed to the conveying passage or channel 12 from the position shown by means of a first conveyor 27 which will be described in greater detail hereinafter, particularly with reference to FIGS. 4 to 6. To feed the cartridge row 20 to the conveying passage or channel 12, the drum magazine must first be rotated about its lengthwise axis 21 through 180°. It will further be evident from FIG. 3 that the firing weapon 13 possesses, for instance, six weapon barrels 14 which rotate about their common axis 22 during repetitive or series firing.

Figure 5:
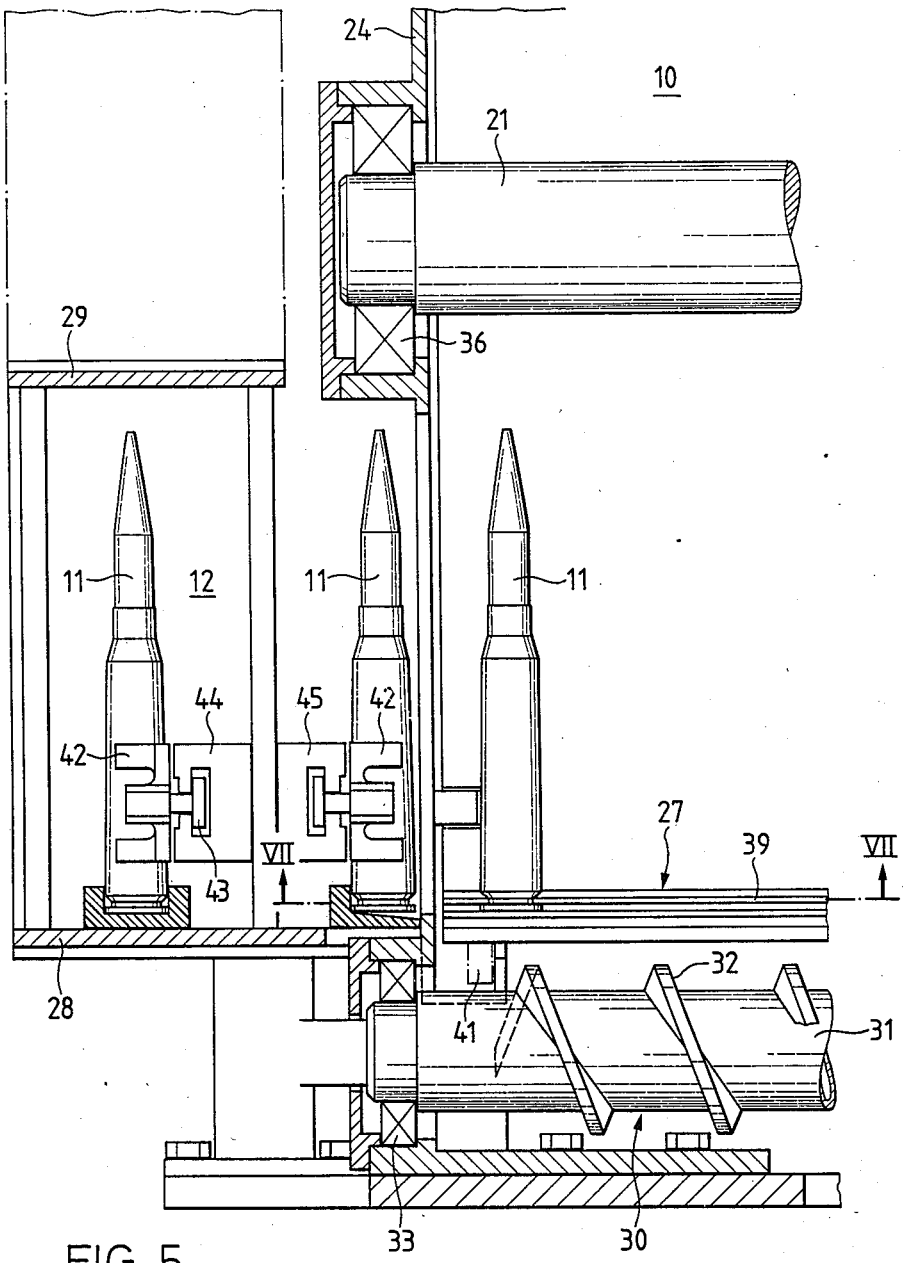
FIG. 5 is a section through the front half of the drum magazine shown in FIG. 1 and equipped with an ammunition feed device and substantially taken along the line V—V of FIG. 4.
Figure 6:
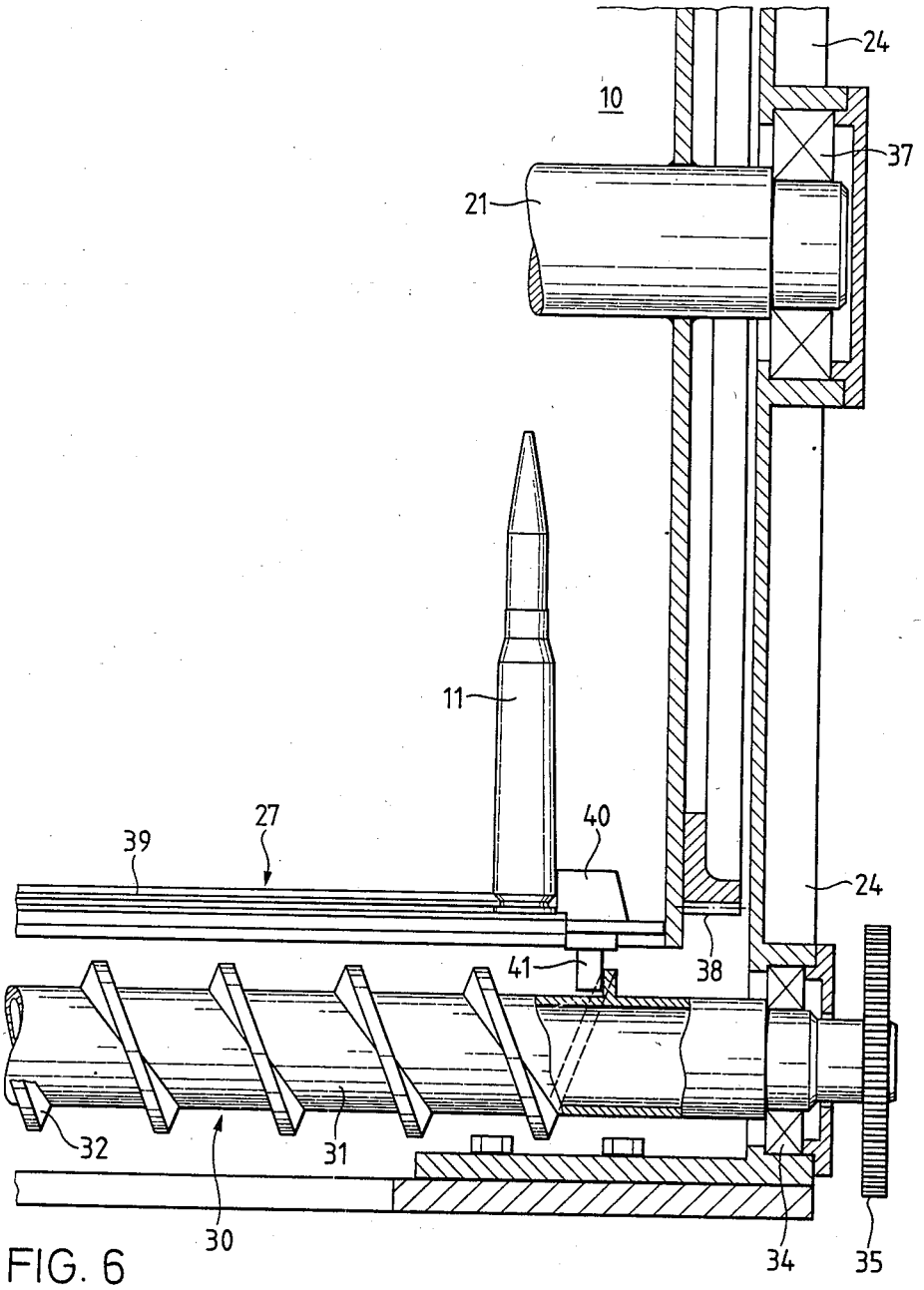
FIG. 6 is a section through the rear half of the drum magazine shown in FIG. 5 and equipped with such ammunition feed device and substantially taken along the line VI—VI of FIG. 4.

As will be understood from the illustration in FIG. 4 of the drawings, the drum magazine 10 comprises thirty sectors or sector-like compartments 23, of which only the central lines are conveniently indicated. Each sector or compartment 23 contains a row or series of twenty-five cartridges 11. FIG. 4 shows only the first cartridge 11 of each row of two sectors 23. The drum magazine 10 is located within a substantially cylindrical housing 24, which is shown in FIGS. 5 and 6, and of which only the substantially disk-shaped front end wall 25 is visible in FIG. 4. This end wall 25 possesses an opening or outlet 26 through which the cartridges 11 can be removed from the drum magazine 10. By means of the first conveyor 27, still to be described hereinafter, one cartridge row or series, such as the rows 19 and 20, after the other will be pushed out through the opening 26 from the drum magazine 10. During such time as one cartridge row 19 is pushed out from the drum magazine 10, the latter continuously rotates by one increment or division, so that the location or position of the drum magazine 10 which is marked A moves to the location or position marked B. In other words, when a cartridge 11 is axially displaced from one end to the other end of the drum magazine 10, the same is rotated through one increment or drum division whereby the cartridge 11 is shifted from the location A to the location B. The cartridges 11 which have been ejected from the drum magazine 10 move through the conveying passage or channel 12, which in FIG. 4 is only indicated by two walls 28, 29 thereof, to the firing weapon 13. A second conveyor 30*a* also to be described further hereinafter, is located in the conveying passage or channel 12. The direction of movement of the cartridges 11 which results from rotation of the drum magazine 10 in the direction of the arrow D and from the axial displacement of the cartridge row 19 coincides with the conveying direction of the first conveyor 27. In other words, the axis of the first conveyor 27 is thus inclined to such extent that its direction coincides with the aforementioned resultant direction of movement as will be clearly recognized from FIG. 4. A return or reverse movement blocking device, also to be described hereinafter, and placed in front of the opening 26 prevents cartridges 11 which have been ejected from the drum magazine 10 by the first conveyor 27, from dropping back again or reverse feeding through the opening 26.

Figure 12:
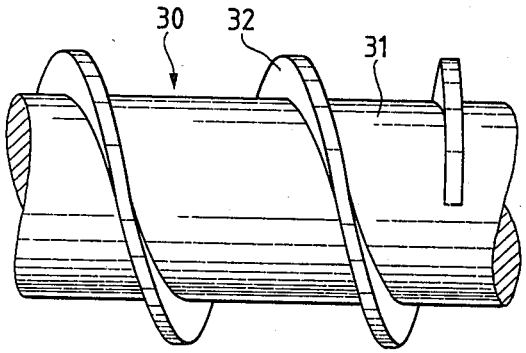
FIG. 12 is an enlarged view of a section of the screw or worm conveyor used in the first embodiment of the inventive feed apparatus or system, specifically of the screw or worm conveyor shown in FIGS. 5 and 6.

The first embodiment of the inventive ammunition feed apparatus or system will now be described with reference to FIGS. 5 and 6 of the drawings, in which the first conveyor 27 is illustrated in detail. This first conveyor 27 comprises a screw or worm conveyor 30 composed of a substantially cylindrical body or core 31 and a helically-shaped web or flight 32 mounted thereat and defining a worm thread. As will be understood from the showing of FIGS. 5, 6 and 12 the helically-shaped web or flight 32 which defines a worm thread is configured such that the first thread turn has a smaller pitch than the remaining turns of the thread, in order to thus facilitate the acceleration of the rows of the cartridges 11 which are initially at standstill in the drum magazine 10. The two ends of the screw or worm conveyor 30 are mounted in bearings 33 and 34, as shown in FIGS. 5 and 6, and supported in the housing 24 of the drum magazine 10. A gear 35 which is mounted at one end of the screw or worm conveyor 30 serves to drive the same. This gear 35 is driven by a suitable drive, such as a hydraulic motor as will be described further below. The drum-type or drum magazine 10 contains a drum shaft 21. The two opposite ends of this drum shaft 21 are mounted in bearings 36 and 37, as shown in FIGS. 5 and 6, which are placed in the housing 24 of the drum magazine 10. As shown in FIG. 6, a gear 38 serves to drive the drum magazine 10. This gear 38 is mounted at one end wall of the drum magazine 10 and is driven by an electromotor as also will be described further below.

Each cartridge row or series 19 and 20 is displaceably held at an axially directed guide rail 39 in the drum magazine 10. In FIG. 5 the first cartridge 11 of the cartridge row 19 and in FIG. 6 the last cartridge 11 of such cartridge row 19 is illustrated. An entraining or entrainment member 40 is displaceable at the guide rail 39 and possesses a bolt 41 or equivalent structure. The bolt 41 is engaged by the helically-shaped web or flight 32 of the screw or worm conveyor 30. By rotating such screw or worm conveyor 30 the entrainment member 40 is displaced from its right-hand terminal position shown in FIG. 6 to the left-hand terminal or end position shown in FIG. 5. During this displacement the row or series 19 of twenty-five cartridges 11 is displaced or pushed from the drum magazine 10. In the already mentioned conveying passage or channel 12 containing the walls or boundary wall members 28 and 29, as shown in FIG. 5, there is located the second conveyor 30*a* which forms the endless conveyor chain 16 which is composed of separate chain links 42 as will be also particularly evident from FIG. 7. Each chain link 42 possesses a substantially T-shaped projection 43 which is guided in a related rail 44 or 45, respectively, which is structured to possess a substantially C-shaped cross-section. At the left-hand rail 44 of the showing of FIG. 5 the chain links 42 including the cartridges 11 move from the drum magazine 10 to the firing weapon 13. At the adjacent rail 45 the empty chain links 42 are returned back from the firing weapon 13 towards the drum magazine 10. At both ends of the guide rails 44 and 45 there are present any suitable deflection or turning rolls by means of which the endless conveyor chain 16 is deflected or turned from one of the two rails 44, 45 into the respective other rail 45, 44.

Figure 7:
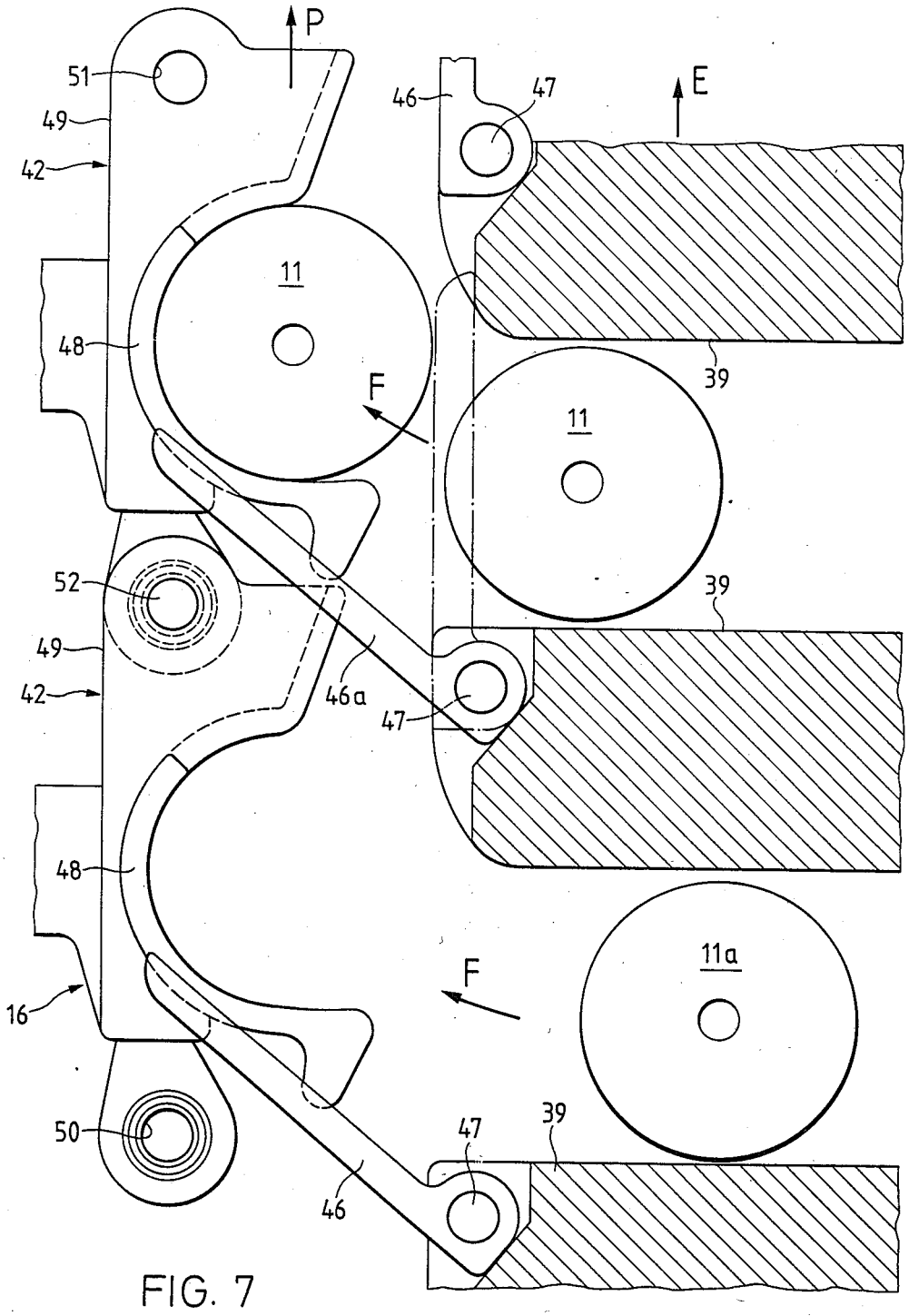
FIG. 7 is a sectional view on a substantially enlarged scale, taken substantially along the line VII—VII in FIG. 5.

According to the showing of FIG. 7, the endless conveyor chain 16 moves transversely relative to the guide rails 39 in the direction of the arrow P. At these guide rails 39 the cartridges 11 are displaced by the entraining or entrainment member 40 towards the endless conveyor chain 16 in the direction of the arrow F. Additionally, due to the rotation of the drum magazine 10 the guide rails 39 move in the direction of the arrow E. A return or reverse movement blocking device constituted by a flap or vane member 46 which is pivotable about an axis or pivot shaft 47, is linked to the end of each guide rail 39 which faces the conveyor chain 16. This flap 46 or equivalent structure is opened and closed by any suitable actuating apparatus. The cartridge 11*a* in a successive row of cartridges recloses the flap 46*a* which is located at the end of a preceding row of cartridges 11. Thus, there is prevented that cartridges 11 will drop back into already emptied drum sectors or compartments 23 when they are located at the endless conveyor chain 16.

Figure 8:
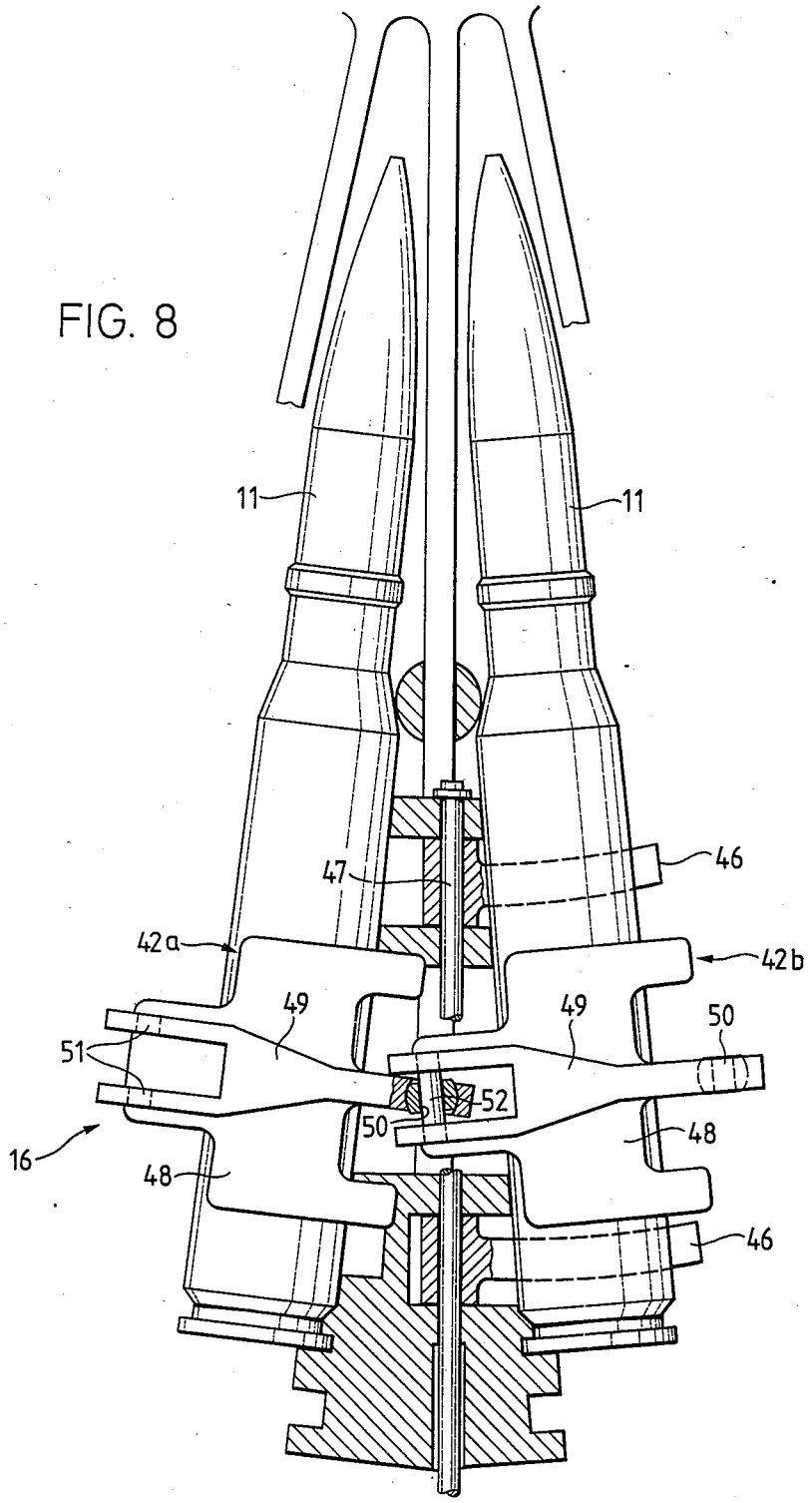
FIG. 8 is a view on an enlarged scale of a detail of the arrangement shown in FIG. 4.

As will be recognized from FIG. 7 one respective flap or flap member 46 is pivotably arranged for pivoting about a related pivot axis or shaft 47 on each side of the chain link 42 of the endless conveyor chain 16. It will also be evident from FIGS. 7 and 8 that each chain link 42 comprises a shell 48 for receiving a cartridge 11. A carrier 49 is mounted at each shell 48 and one end of the carrier 49 is divided in a fork-like or bifurcated manner. Bores 50 and 51 are present at both ends of the carrier 49. When the chain links 42 are assembled, the end with the bore 50 of one chain link 42*a* will be located within the forked or bifurcated end of the adjacent chain link 42*b*, as shown in FIG. 8. The separate chain links 42 are articulated to each other by bolts 52 or the like.

Figure 9:
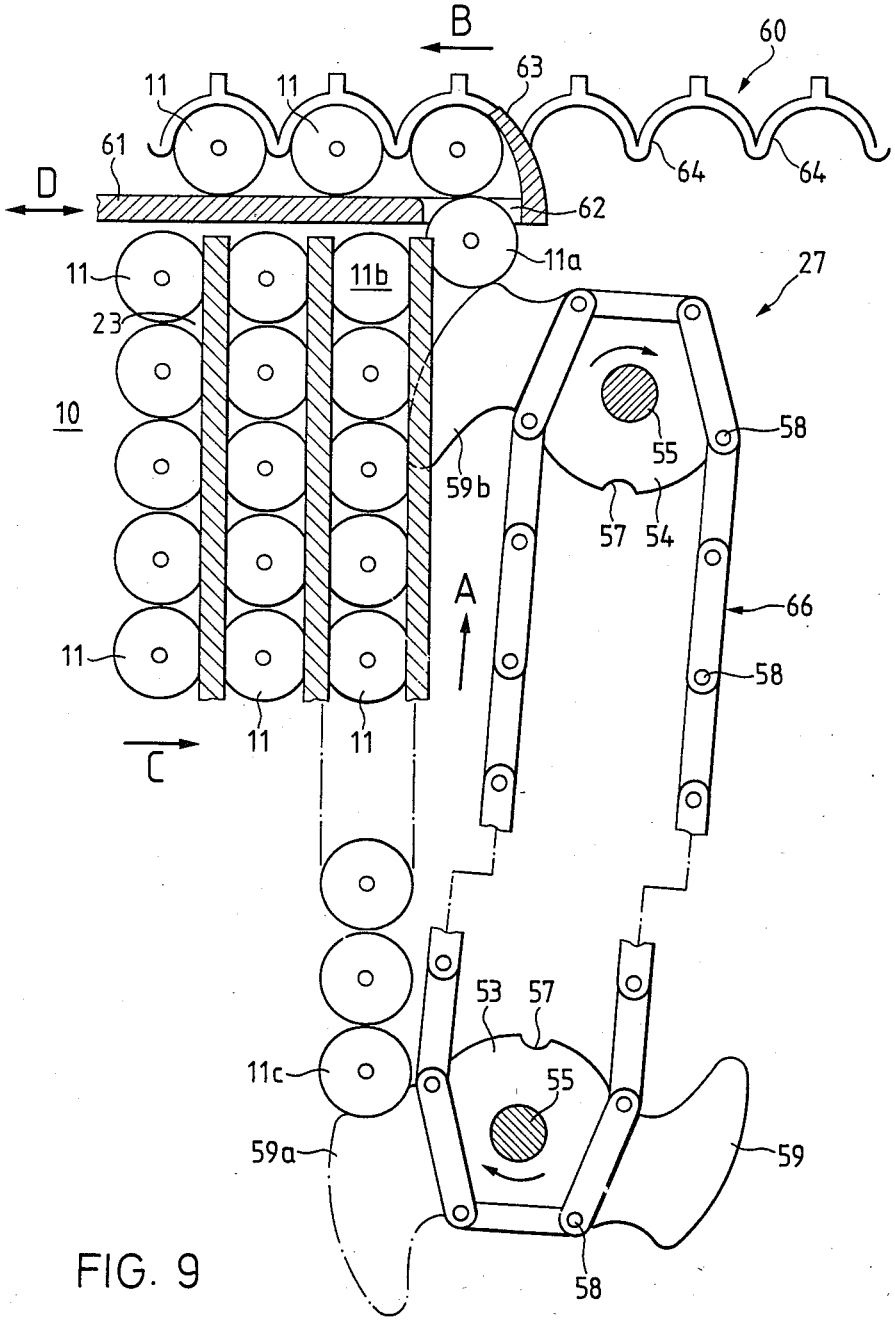
FIG. 9 illustrates a second embodiment of the feed apparatus or system according to the invention.

A second embodiment of the ammunition feed apparatus or system according to the invention is illustrated in FIG. 9, particularly constituting a modification of the first conveyor shown in FIGS. 5 and 6. Here the first conveyor comprises a top or upper sprocket wheel 54 having five recesses or depressions 57 and an endless conveyor chain 66 containing chain links 58 engageable with these recesses 57. A bottom or lower sprocket wheel 53 is designed in the same way as the top or upper sprocket wheel 54, as will be seen from FIG. 9. Equidistantly spaced entraining or entrainment members 59 are mounted at the endless chain 66. These entrainment members 59 have the task of discharging cartridges 11 from the sectors or compartments 23 of the drum-type or drum magazine 10. The cartridges 11 which have been pushed out from the drum magazine 10 are fed to a second conveyor which is formed, for instance, by a second conveyor chain 60. This second conveyor chain 60 moves in the direction of the arrow B across the drum magazine 10 and feeds the cartridges 11 to the firing weapon 13. The endless first conveyor chain 66 moves in the direction of the arrow A and the drum magazine 10 rotates in the direction of the arrow C, as will be recognized from FIG. 9.

A slide member or slider 61 is located beneath the second conveyor chain 60 and above the cartridges 11 which are arranged in the drum magazine 10. This slide member 61 comprises a throughpassage opening or outlet 62 and a deflector nose or lug 63 which ensures that the cartridges 11 will precisely pass into the individual receiving cups or cup-like receivers 64 of the second conveyor chain 60. The slide member 61 is displaced back-and-forth in the direction of the bidirectional or double headed arrow D by means of a suitable cam or an eccentric plate which is not shown in any particular detail. As soon as the last cartridge 11*a* of one of the cartridge rows is located in the second conveyor chain 60, then the slide member 61 is displaced towards the left in FIG. 9 in the direction of the arrow B until the throughpassage opening 62 thereof is placed above the first cartridge 11*b* of the next successive cartridge row. Thereafter the slide member 61 is displaced in the direction of the arrow C to the right in FIG. 9 at the same speed as the drum magazine 10, so that the throughpassage opening 62 of such slide member 61 is continuously located above the cartridge row presently being discharged from the drum magazine 10.

As will be further evident from FIG. 9, the entrainment member 59 also migrates towards the right in FIG. 9, in the direction of the arrow C, due to the inclined position of the first conveyor chain 66 during such time as this entrainment member 59 discharges or outfeeds a cartridge row from the drum magazine 10, i.e. during the period of time that the entrainment member 59 passes from its lower position 59*a* into its upper position 59*b*. The inclination of the endless first conveyor chain 66 relative to the vertical is selected in such a manner that the entrainment member 59 moves in the direction of the arrow C at the same speed or velocity as the drum magazine 10. The entrainment member 59 thus continuously remains engaged with the lowermost cartridge 11*c* of a cartridge row or series located in a respective sector or drum compartment 23 during its upwardly directed movement.

The entrainment member 59 is configured in such a manner that it remains in contact with the last cartridge 11*a* in a cartridge row or series until the same is completely pushed into a receiving cup or receiver 64 of the second conveyor chain 60. Any free or unguided flight of a cartridge 11 during its entry into the second conveyor chain 60 is thus beneficially avoided.

Figure 10:
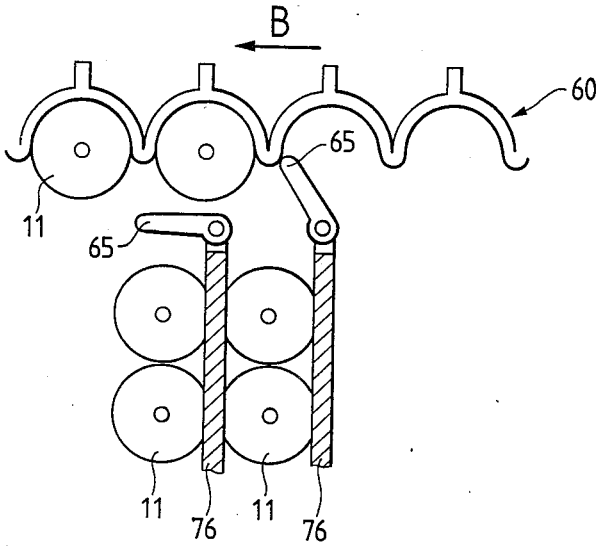
FIG. 10 is a view of a third embodiment of the feed apparatus or system according to the invention and specifically depicts a modified return or reverse movement blocking device from that shown in FIG. 9.

In the third embodiment of the feed apparatus or system according to the invention which is illustrated in FIG. 10 the slide member 61 of the previously described second embodiment which is shown in FIG. 9 is here replaced by pivotable flaps or flap members 65. These flaps 65 are linked or hingedly connected to partitions or intermediate walls 76 of the drum magazine 10 and are opened and closed by any suitable actuator apparatus. According to FIG. 10 the second conveyor chain 60 moves towards the left in the direction of the arrow B. The flaps 65 are thus correspondingly opened by pivoting the same in counterclockwise direction by the action of the cartridges 11 as shown in FIG. 10.

Figure 11:
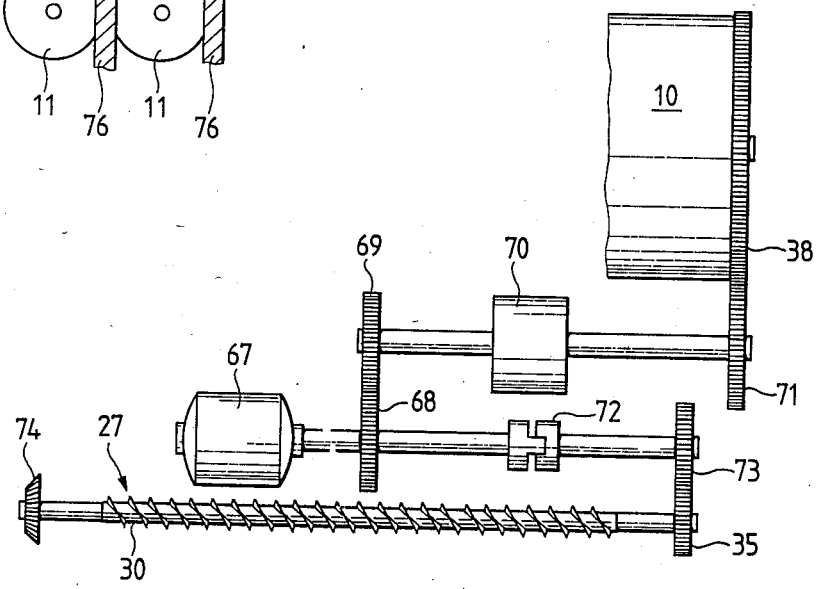
FIG. 11 is a schematic illustration of a gear transmission for use with the inventive ammunition feed apparatus or system.

According to the arrangement of FIG. 11 the drum magazine 10 is driven by a hydraulic motor 67 via gears 68, 69, a step-down transmission or gearing 70 and the gears 71 and 38, reference also being made to FIG. 6. Furthermore, the screw or worm conveyor 30 of the first conveyor 27 is driven by the hydraulic motor 67 via a clutch 72 or equivalent structure and the gears 73 and 35, again reference being made to FIG. 6. The second conveyor 30*a*, see FIG. 2, is driven by a further gear 74 which is mounted at the screw or worm conveyor 30. It will be understood that the transmission ratio of the step-down gearing illustrated in FIG. 11 should be selected such that all of the cartridge rows or series 19 and 20 are ejected by the first conveyor 27 during each revolution of the drum magazine 10.

While there are shown and described present preferred embodiments of the invention, it is to be distinctly understood that the invention is not limited thereto, but may be otherwise variously embodied and practiced within the scope of the following claims.

Accordingly, what we claim is:

1. A feed apparatus for feeding cartridges to a firing weapon from a drum magazine subdivided into a predetermined number of sectors extending axially of said drum magazine and in each of which one respective axial row of cartridges is accommodated, comprising:

a first conveyor for successively discharging one axial row of said cartridges after the other from related ones of said axially extending sectors of said drum magazine;

a second conveyor for actively conveying said cartridges which have been discharged from said sectors of said drum magazine to said firing weapon; and a return movement blocking device arranged between said first conveyor and said second conveyor for preventing cartridges which have been discharged from dropping back into previously emptied ones of said axially extending sectors of said drum magazine.

2. The feed apparatus as defined in claim 1, wherein:

said second conveyor comprises a chain conveyor comprising a series of individual cartridge-receiving cup members, each of which is structured to accommodate one of said cartridges;

said return movement blocking device comprising a slide member; and said slide member having a throughpassage opening for the throughpassage of said cartridges which have been ejected from said drum magazine and a deflector for directing said cartridges into respective ones of said individual cartridge-receiving cup members of said chain conveyor.

3. The feed apparatus as defined in claim 1, wherein:

said drum magazine is operatively associated with an opening through which each said axial row of cartridges is conveyed by said first conveyor to said second conveyor;

drive means for rotatably driving said drum magazine relative to said opening;

said drum magazine, during its rotation under the action of said drive means, moving in a predetermined direction of movement in the region of said opening;

said second conveyor conveying said cartridges in a predetermined conveying direction; and said predetermined conveying direction of said second conveyor extending substantially parallel to said predetermined direction of movement of said drum magazine in the region of said opening.

4. The feed apparatus as defined in claim 1, wherein:

said return movement blocking device comprises pivotable flaps;

said drum magazine being provided with guide rails each of which has a respective discharge end; and each one of said pivotable flaps being pivotably mounted at a respective one of said discharge ends and assuming an open position when said cartridges are discharged from said drum magazine but preventing said discharged cartridges from dropping back into said sectors of said drum magazine.

5. The feed apparatus as defined in claim 4, further including:

means for rotating said drum magazine in a predetermined direction of rotation; and said pivotable flaps being arranged to open-up in a pivoting direction thereof which is the same as said predetermined direction of rotation of said drum magazine.

6. The feed apparatus as defined in claim 4, further including:

means for rotating said drum magazine in a predetermined direction of rotation; and said pivotable flaps being arranged to open-up in a pivoting direction thereof which is opposite to said predetermined direction of rotation of said drum magazine.

7. A feed apparatus for feeding cartridges to a firing weapon from a drum magazine subdivided into a predetermined number of sectors extending axially of said drum magazine and in each of which a respective axial row of cartridges is accommodated, comprising:

a first conveyor successively discharging one of said axial rows of cartridges after the other from related ones of said axially extending sectors of said drum magazine;

said first conveyor comprising a screw conveyor provided with a helical web defining a screw thread having a predetermined pitch; and said screw thread having a first thread turn which has a smaller pitch than said predetermined pitch of the remaining thread turns of said screw thread, in order to facilitate the acceleration of each one of said axial rows of cartridges in said drum magazine from a standstill condition thereof.

8. The feed apparatus as defined in claim 7, wherein: said first conveyor extends laterally of said drum magazine.

9. The feed apparatus as defined in claim 7, further including:

a second conveyor for conveying said cartridges discharged from said axially extending sectors of said drum magazine to said firing weapon;

said drum magazine being operatively associated with an opening through which each said axial row of cartridges is conveyed by said first conveyor to said second conveyor;

drive means for rotatably driving said drum magazine relative to said opening;

said drum magazine, during its rotation under the action of said drive means, moving in a predetermined direction of movement in the region of said opening;

said second conveyor conveying said cartridges in a predetermined conveying direction; and said predetermined conveying direction of said second conveyor extending substantially parallel to said predetermined direction of movement of said drum magazine in the region of said opening.

10. The feed apparatus as defined in claim 7, further including:

means for rotating said drum magazine in a predetermined direction of rotation;

each said axially extending sector in said drum magazine assuming a discharge position during such time as said drum magazine is rotated in said predetermined direction of rotation;

each said axial row of cartridges being displaced in a first predetermined direction of displacement from the axially extending sector in said discharge position thereof;

each said axial row of cartridges having a cartridge constituting a first one of said cartridges in the axial row and a further cartridge constituting a last one of said cartridges in said axial row to be ejected from said axially extending sector of said drum magazine;

said first conveyor being arranged in an inclined position defined as a resultant of said predetermined direction of rotation of said drum magazine and said predetermined direction of displacement of each one of said axial rows of cartridges; and said last cartridge in each one of said axial cartridge rows being substantially simultaneously ejected along with said first cartridge of each next successive axial cartridge row from said drum magazine.

11. The feed apparatus as defined in claim 10, further including:

an entrainment member located rearwardly of said last cartridge of the axial row to be ejected;

said entrainment member comprising a bolt protruding into said helical web of said screw conveyor;

guide rails provided for each one of said axially extending sectors in said drum magazine; and one respective axial row of said cartridges being guided in each of said guide rails.

12. A feed apparatus for feeding cartridges to a firing weapon from a drum magazine subdivided into a predetermined number of sectors in each of which one respective cartridge row is accommodated, comprising:

a first conveyor for successively discharging said rows of cartridges from said sectors of said drum magazine;

a second conveyor for conveying said cartridges which have been discharged from said sectors of said drum magazine to said firing weapon;

a return movement blocking device arranged between said first conveyor and said second conveyor for preventing cartridges which have been discharged from dropping back into previously emptied ones of said sectors of said drum magazine;

means for rotating said drum magazine in a predetermined direction of rotation;

each said sector in said drum magazine assuming a discharge position during such time as said drum magazine is rotated in said predetermined direction of rotation;

each said row of cartridges being displaced in a first predetermined direction of displacement from the sector in said discharge position thereof;

each said row of cartridges having a cartridge constituting a first one of said cartridges in the row and a further cartridge constituting a last one of said cartridges in said row to be ejected from said sector of said drum magazine;

said first conveyor being arranged in an inclined position defined as a resultant of said predetermined direction of rotation of said drum magazine and said predetermined direction of displacement of each of said rows of cartridges; and said last cartridge in one of said cartridge rows first being substantially simultaneously ejected along with said first cartridge of a next successive cartridge row from said drum magazine.

13. The feed apparatus as defined in claim 12, further including:

said return movement blocking device comprises pivotable flaps; and said pivotable flaps being arranged to open up in a pivoting direction which is opposite to said direction of rotation of said drum magazine.

14. The feed apparatus as defined in claim 12, wherein:

said first conveyor constitutes a screw conveyor having a helical web;

an entrainment member located rearwardly of said last cartridge of the row to be ejected;

said entrainment member comprising a bolt protruding into said helical web of said screw conveyor;

guide rails provided for each said sector in said drum magazine; and one respective row of said cartridge being guided in each of said guide rails.

* * * * *